US011833405B2

(12) United States Patent
Egan

(10) Patent No.: US 11,833,405 B2
(45) Date of Patent: Dec. 5, 2023

(54) GOLF SHOT ALIGNMENT SYSTEM

(71) Applicant: Leslie Egan, Ennis (IE)

(72) Inventor: Leslie Egan, Ennis (IE)

( * ) Notice: Subject to any disclaimer, the term of this patent is extended or adjusted under 35 U.S.C. 154(b) by 279 days.

(21) Appl. No.: 17/416,574

(22) PCT Filed: May 24, 2019

(86) PCT No.: PCT/EP2019/063532

§ 371 (c)(1),
(2) Date: Jun. 21, 2021

(87) PCT Pub. No.: WO2019/224379

PCT Pub. Date: Nov. 28, 2019

(65) Prior Publication Data

US 2022/0134206 A1 May 5, 2022

(30) Foreign Application Priority Data

May 24, 2018 (IE) ..... S2018/0153

(51) Int. Cl.
*A63B 69/36* (2006.01)
*A63B 24/00* (2006.01)

(52) U.S. Cl.
CPC .. *A63B 69/3632* (2013.01); *A63B 2024/0037* (2013.01); *A63B 2220/20* (2013.01); *A63B 2220/40* (2013.01); *A63B 2220/803* (2013.01); *A63B 2220/833* (2013.01); *A63B 2225/74* (2020.08)

(58) Field of Classification Search
CPC ..... A63B 69/3632; A63B 2024/0037; A63B 2220/20; A63B 2220/40; A63B 2220/803; A63B 2220/833; A63B 2225/74; A63B 71/0622; A63B 2071/0694; A63B 2220/50
USPC ..... 473/221–223
See application file for complete search history.

(56) References Cited

U.S. PATENT DOCUMENTS

| | | | | |
|---|---|---|---|---|
| 8,696,482 | B1 * | 4/2014 | Pedenko | A63B 24/0003 473/223 |
| 8,905,856 | B2 | 12/2014 | Parke et al. | |
| 10,099,102 | B1 * | 10/2018 | Koo | G09B 19/0038 |
| 2005/0261073 | A1 | 11/2005 | Farrington et al. | |

(Continued)

OTHER PUBLICATIONS

International Search Report prepared by the European Patent Office under Application No. PCT/EP2019/063532, dated Sep. 19, 2019, 4 pages.

(Continued)

*Primary Examiner* — Nini F Legesse
(74) *Attorney, Agent, or Firm* — Michael Crilly, Esquire

(57) ABSTRACT

A golf shot alignment system assists a golfer to align a golf club face towards a selected target. The golf shot alignment system comprises a target selection device which is remote from a golf club mounted indicator device which is mounted on a golf club having the golf club face. The target selection device can communicate wirelessly with the golf club mounted indicator device so as to provide target information from the target selection device to the golf club mounted indicator device. The golf club mounted indicator device uses the target information which it receives to determine when the golf club face is aligned towards the selected target and then indicates this to the golfer.

7 Claims, 5 Drawing Sheets

(56) References Cited

U.S. PATENT DOCUMENTS

| | | | | |
|---|---|---|---|---|
| 2011/0021293 | A1* | 1/2011 | York | A63B 71/06 473/409 |
| 2014/0106892 | A1* | 4/2014 | Lin | G09B 19/0038 473/223 |
| 2015/0182825 | A1* | 7/2015 | O'Connor | G01C 11/06 473/406 |
| 2015/0258410 | A1 | 9/2015 | Landsman et al. | |
| 2016/0271445 | A1* | 9/2016 | Kolloff | G09B 19/0038 |
| 2017/0252607 | A1* | 9/2017 | Haas | A61B 5/11 |
| 2017/0368438 | A1* | 12/2017 | Landsman | A63B 69/3608 |

OTHER PUBLICATIONS

Written Opinion of the International Searching Authority prepared by the European Patent Office under Application No. PCT/EP2019/063532, dated Nov. 24, 2020, 7 pages.

* cited by examiner

GOLF SHOT ALIGNMENT SYSTEM

CROSS REFERENCE TO RELATED APPLICATIONS

This application is a national phase to PCT Application No. PCT/EP2019/063532 filed May 24, 2019 which in turn claims priority to Irish Patent Application No. S2018/0153 filed May 24, 2018, wherein all said applications incorporated in their entirety herein by reference thereto.

GOVERNMENT SPONSORED RESEARCH AND DEVELOPMENT

None.

BACKGROUND OF THE INVENTION

1. Field of the Invention

This invention relates to a golf shot alignment device and system.

In particular, one embodiment of the present invention is directed towards a club-mounted aiming indicator which co-operates with a viewfinder and/or a software-based application to form a system which can be used to indicate to a golfer when the club the golfer is holding is aligned correctly towards a chosen target. Moreover, another embodiment of the present invention is directed towards a golf club mounted golf shot alignment device which can be used to indicate to a golfer when the club the golfer is holding is aligned correctly towards a chosen target.

Throughout this specification, the term "viewfinder" shall be understood to encompass any type of device which may be used by a golfer to select a target in the distance which they will aim their golf shot towards.

2. Background

Golf is a widely played game throughout the World. A game of golf is won by completing all of the holes on the course in the fewest number of golf shots. Thus, it is imperative that a golfer aligns their golf club correctly towards their chosen target. A large majority of golfers are able to correctly select the target area where their next golf shot should be played, however up to 95% of golfers then introduce an alignment error when setting up their golf shot. This causes many golf shots to veer away from the intended target and results in golfers handing in higher score cards.

In addressing a golf ball, to strike the golf ball towards the intended target, the golfer should align the club face substantially orthogonally to an imaginary aiming line which is directed from the golf ball towards the intended target. If the golf club is aligned and swung correctly, the likelihood of this striking the golf ball towards the intended target substantially increases.

Most individuals have stronger vision in one eye over the other. And when a golfer transitions from facing the target area straight on, to facing the target sideways on, thus adopting the position to swing their golf club, alignment errors are introduced. This is exacerbated by the golfer having stronger vision in one eye over the other, and this is further worsened when the golfer stands side on, addressing the golf ball to be struck, with either the weaker eye or stronger eye in front of the other and thus biasing their vision and perception of where to aim to strike towards the target.

It is a goal of the present invention to provide an apparatus that overcomes at least one of the above-mentioned problems by assisting a golfer in aligning their golf club correctly when addressing their golf ball, so as to strike the golf ball towards an intended target.

The present invention is intended to be used on golf courses, during practice rounds; however, it will be appreciated that use of the present invention in swing bays, on driving ranges, and the like is also envisaged.

SUMMARY

The present invention is generally concerned with assisting a golfer to align a golf club face towards a selected target by offering the golfer a target selection device which can capture a direction towards the target and an indicator device which can inform the golfer when their golf club face is aligned towards the selected target.

One of the embodiments of the present invention is directed to a golf club mounted golf shot alignment device for assisting a golfer to align a golf club face towards a selected target; the golf shot alignment device comprising a target selection device and an indicator device; the golf shot alignment device being mounted on a golf club which comprises the golf club face; the target selection device being capable of communicating with the indicator device so as to provide target information from the target selection device to the indicator device; and, the indicator device comprising means to use the target information to determine when the golf club face is aligned towards the selected target.

The advantage of providing the golf shot alignment device is that a golfer will receive feedback from the indicator mounted on their golf club as they are aligning their golf club during the shot set-up. This feedback will allow the golfer to aim the face of their golf club suitably towards the selected target, thus increasing the likelihood that the golfer will strike their golf ball in the direction of the selected target. With all of the components being integrated into a single golf-club mounted device, it will be appreciated that this embodiment of the present invention provides an easy to use, relatively low-cost implementation of the present invention.

In a further embodiment, the target selection device comprises an orientation means, a means of capturing an orientation from the orientation means upon command, and, a means for transmitting the captured orientation, in the form of the target information, to the indicator device.

In a further embodiment, the indicator device comprises means for receiving target information from the target selection device, means for determining a positioning of the golf club face; and an indicator to indicate when the positioning of the golf club face is suitable to align the golf club face towards the selected target.

In a further embodiment, the golf club mounted golf shot alignment device comprises means to mount the golf club mounted golf shot alignment device on a top end portion of a golf club, the top end portion being at an opposite end of the golf club to the golf club face.

In a further embodiment, the indicator device comprises a light to provide feedback on the alignment of the golf club face. In a further embodiment, the indicator device comprises a haptic engine to provide feedback on the alignment of the golf club face.

In a further embodiment, the light of the indicator device changes from a first colour to a second colour to indicate when the golf club face has been aligned to the selected target.

In a further embodiment, the golf club mounted golf shot alignment device comprises a tip switch which powers down the golf club mounted golf shot alignment device when the golf club mounted golf shot alignment device is rotated to a preset angle.

In a further embodiment, the golf club mounted golf shot alignment device comprises one or more of: an accelerometer, a gyroscope, a magnetometer, and a compass and a processor to use the target information and the information from the accelerometer, the gyroscope, the magnetometer and/or the compass, so as to determine when the golf club face is aligned towards the selected target.

In a further embodiment, the target information and/or the aiming information is a directional vector from a current location to the target location and/or GPS co-ordinates of the selected target.

In a different embodiment the target selection device and the indicator device may be separate devices, operated remotely from one another, and communicating wirelessly with one another. To this end, the present invention is further directed to a golf shot alignment system for assisting a golfer to align a golf club face towards a selected target; the golf shot alignment system comprising a target selection device which is remote from a golf club mounted indicator device; the golf club mounted indicator device being mounted on a golf club which comprises the golf club face; the target selection device being capable of communicating wirelessly with the golf club mounted indicator device so as to provide target information from the target selection device to the golf club mounted indicator device; and, the golf club mounted indicator device comprising means to use the target information to determine when the golf club face is aligned towards the selected target.

The advantage of providing the golf shot alignment system is that a golfer will receive feedback from the indicator mounted on their golf club as they are aligning their golf club during the shot set-up. This feedback will allow the golfer to aim the face of their golf club suitably towards the selected target, thus increasing the likelihood that the golfer will strike their golf ball in the direction of the selected target.

In a further embodiment, the target selection device comprises a viewfinder; the viewfinder comprising an orientation means, a means of capturing an orientation from the orientation means upon command and, a transmitter for wirelessly transmitting the captured orientation, in the form of the target information, to the golf club mounted indicator device.

In a further embodiment, the target selection device comprises a handheld unit; the handheld unit comprising a location means to provide a current location, a screen to display at least a portion of a surrounding area, an adjustable on-screen aiming line which emanates from the provided current location to a selected on-screen target and is overlaid on the displayed surrounding area on the screen, a means for determining the target information based on the selected on-screen target, and, a transmitter for wirelessly transmitting the target information to the golf club mounted indicator device.

In a further embodiment, the target selection device comprises a handheld unit and a viewfinder; the handheld unit comprising a location means to provide a current location, a screen to display at least a portion of a surrounding area, an adjustable on-screen aiming line which emanates from the provided current location to a selected on-screen target and is overlaid on the displayed surrounding area on the screen, a means for determining aiming information based on the selected on-screen target, and, a connection for sending the aiming information to a viewfinder; the viewfinder comprising an orientation means and a means of capturing an orientation from the orientation means upon command, and, a transmitter for wirelessly transmitting the captured orientation, in the form of the target information, to the golf club mounted indicator device.

In a further embodiment, the handheld unit and the viewfinder are physically connected together.

In a further embodiment, the viewfinder comprises a bracket for mounting the handheld unit within such that the handheld unit and the viewfinder are physically connected together.

In a further embodiment, the golf club mounted indicator device comprises means for receiving target information from the target selection device, means for determining a positioning of the golf club face; and an indicator to indicate when the positioning of the golf club face is suitable to align the golf club face towards the selected target.

In a further embodiment, the golf club mounted indicator device comprises means to mount the golf club mounted indicator device on a top end portion of a golf club, the top end portion being at an opposite end of the golf club to the golf club face.

In a further embodiment, the golf club mounted indicator device comprises a light to provide feedback on the alignment of the golf club face. In a further embodiment, the golf club mounted indicator device comprises a haptic engine to provide feedback on the alignment of the golf club face.

In a further embodiment, the light of the golf club mounted indicator device changes from a first colour to a second colour to indicate when the golf club face has been aligned to the selected target.

In a further embodiment, the golf club mounted indicator device comprises a tip switch which powers down the golf club mounted indicator device when the golf club mounted indicator device is rotated to a preset angle.

In a further embodiment, the handheld unit is a smartphone. In a further embodiment, the viewfinder is a rangefinder.

In a further embodiment, the target selection device communicates wirelessly with the golf club mounted indicator device via Bluetooth. In a further embodiment, the target selection device communicates wirelessly with the golf club mounted indicator device via infrared. In a further embodiment, the target selection device communicates wirelessly with the golf club mounted indicator device via ZigBee. In a further embodiment, the target selection device communicates wirelessly with the golf club mounted indicator device via a cellular network. In a further embodiment, the target selection device communicates wirelessly with the golf club mounted indicator device via WiFi. In a further embodiment, the target selection device communicates wirelessly with the golf club mounted indicator device via WiMAX.

In a further embodiment, the golf club mounted indicator device comprises one or more of: an accelerometer, a gyroscope, a magnetometer, and a compass and a processor to use the target information and the information from the accelerometer, the gyroscope, the magnetometer and/or the compass, so as to determine when the golf club face is aligned towards the selected target.

In a further embodiment, the target information and/or the aiming information is a directional vector from a current location to the target location and/or GPS co-ordinates of the select target.

BRIEF DESCRIPTION OF THE DRAWINGS

The invention will be more clearly understood from the following description of some embodiments thereof, given by way of example only, with reference to the accompanying drawings.

DETAILED DESCRIPTION OF THE EMBODIMENTS

Figure 1:
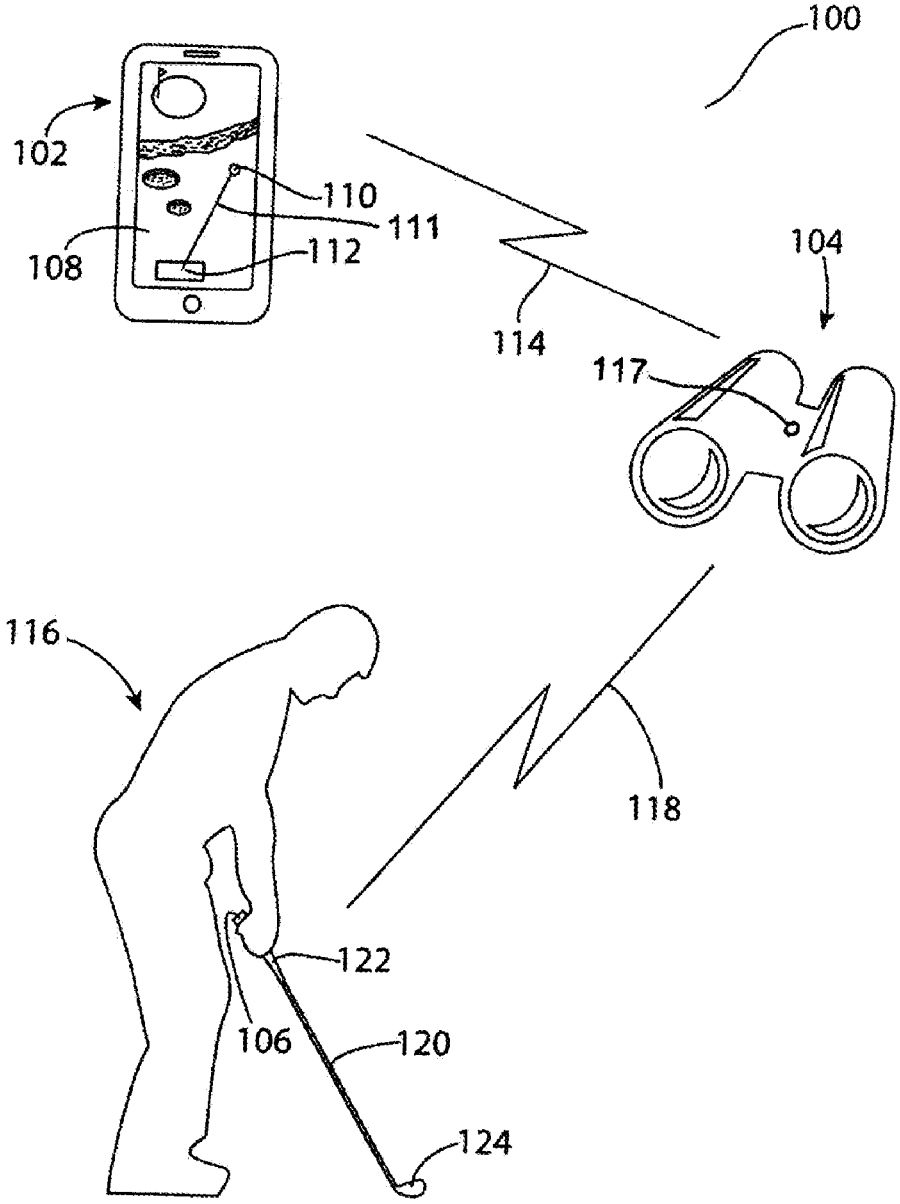
FIG. 1 is a diagrammatic view of various components of a golf shot alignment system according to the present invention.

Referring to FIG. 1, there is provided golf shot alignment system, in accordance with one embodiment of the present invention, indicated generally by reference numeral 100. The golf shot alignment system 100 assists a golfer indicated generally by reference numeral 116 to align a golf club face 124 towards a selected target 110. The golf shot alignment system 100 comprises a target selection device indicated generally by reference numerals 102, 104 which is remote from a golf club mounted indicator device 106. The golf club mounted indicator device 106 is mounted on a golf club 120 which comprises the golf club face 124.

The target selection device 102, 104 can communicate wirelessly with the golf club mounted indicator device 106 so as to provide target information from the target selection device 102, 104 to the golf club mounted indicator device 106.

The golf club mounted indicator device 106 uses the target information which it receives to determine when the golf club face 124 is aligned towards the selected target 110 and then indicates this to the golfer 116.

In the preferred embodiment of the invention, the target selection device 102, 104 comprises a handheld unit indicated generally by reference numeral 102 and a viewfinder indicated generally by reference numeral 104. However, it will be appreciated that the present invention may operate by having the handheld unit 102 acting solely as the target selection device, or, by having the viewfinder 104 acting solely as the target selection device. The advantage, it has been found, by forcing a golfer 116 to select the target through the viewfinder 104 is that the golfer 116 becomes accustomed to selecting a target when standing facing on to the target area, and then associating the correct club alignment to the selected target, when the golfer 116 is standing side on whilst addressing the golf ball to be struck.

The handheld unit 102 comprises a location means (not shown) to provide a current location. This will typically be provided by way of a GPS component device incorporated into the handheld unit 102. The handheld unit 102 comprises a screen 108 to display at least a portion of a surrounding area. The surrounding area, it will be appreciated, will typically be a satellite map or a diagrammatic view of at least a portion of the golf hole currently being played by the golfer 116. The handheld unit 102 preferably comprises a touchscreen so as to allow the golfer 116 to adjust an on-screen aiming line 111. The aiming line 111 emanates from the provided current location 112 and extends to the selected on-screen target 110. It will be appreciated that the aiming line 111 will be overlaid on the displayed surrounding area on the screen 108. The golfer 116 can simply move the aiming line 111 around on the screen 108 to select a target point 110 on the map which they wish to aim their next golf shot towards.

In a preferred embodiment, the handheld unit 102 may provide distance to target information, and/or club selection information (based on historical records for the golfer's average distances per club, or based on information input by the golfer). The handheld unit 102 will also comprise a means for determining the target information, or alternatively referred to as aiming information, based on the selected on-screen target. The target information/aiming information may be a direction vector, or target co-ordinates, or the like. If the handheld unit 106 is acting on its own, then the handheld unit 106 will comprise a wireless transmitter (not shown) for wirelessly transmitting 114, 118 the target information to the golf club mounted indicator device 106. Alternatively, if the viewfinder 104 is being used in conjunction with the handheld unit 102, then the handheld unit 102 will comprise a wireless transmitter or a wired connection (not shown) for wirelessly transmitting 114 or sending the aiming information to the viewfinder 104.

Figure 2:
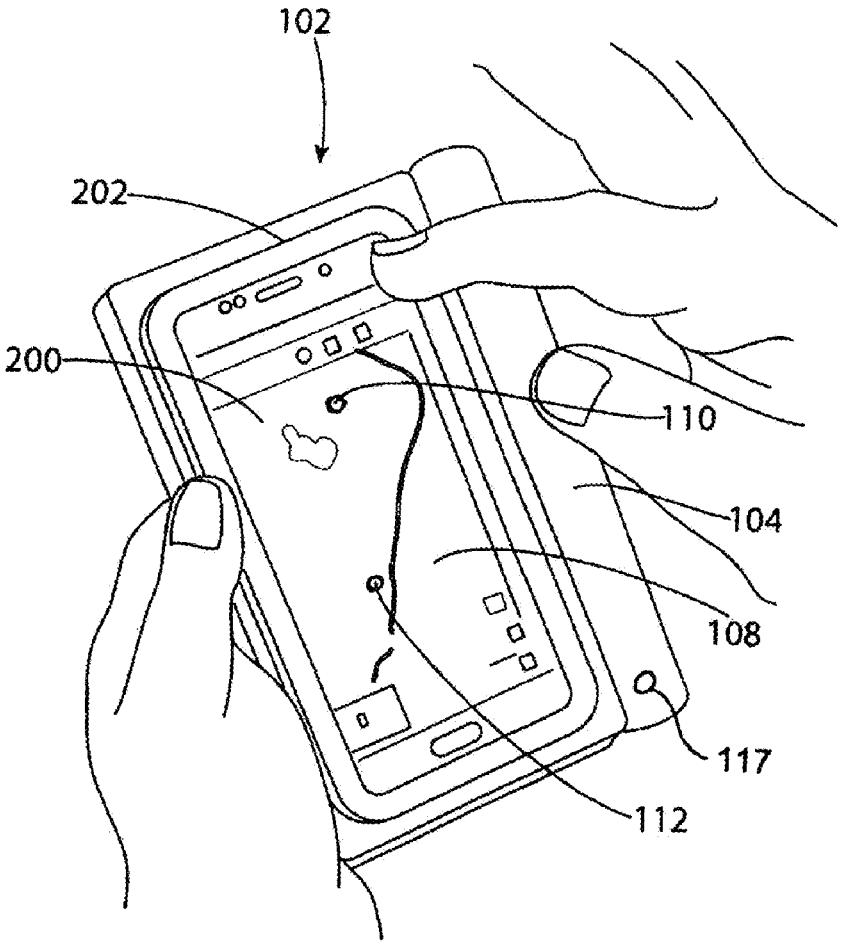
FIG. 2 is a perspective view of a handheld device executing a software-based application which may be used in a preferred embodiment of the present invention.

Turning briefly to FIG. 2, the handheld unit 102 is shown mounted in a bracket 202 comprising a physically connected viewfinder 104. A satellite map 200 is displayed on the screen 108. The handheld unit 102 is a smartphone in this embodiment.

Returning to FIG. 1, the viewfinder 104 comprises an orientation means (not shown) for assessing which orientation the viewfinder 104 currently has. This orientation means may simply be a compass, or magnetometer, which can provide information on the directional orientation of the viewfinder 104. When the golfer 116 presses a capture button 117 there will be means, such as a memory, for capturing the orientation from the orientation means. The golfer 116 may be prompted to press the capture button 117 when the viewfinder 104 is aiming at the selected on-screen target 110. The aiming information can be cross-checked continually against the orientation provided by the orientation means and can indicate to the golfer 116 when the current orientation of the viewfinder 104 is in agreement with the provided aiming information from the handheld unit 102. This prompt may be a light, or sound, or tactile vibration. One preferred example is to turn a cross-hair on the viewfinder 104 to a different colour, say green, when the current orientation of the viewfinder 104 is in agreement with the provided aiming information from the handheld unit 102. When the golfer 116 presses the capture button on the viewfinder 104, the target information, which will be based on the current orientation of the viewfinder 104 and/or on the aiming information, will be wirelessly transmitted to the golf club mounted indicator device 106 by a transmitter (not shown) in the viewfinder 104.

In an alternative embodiment, where the viewfinder 104 is acting without the handheld unit 102, the golfer 116 will be prompted to press the capture button 117 when the golfer 116 views their selected target through the viewfinder 104. Again, when the golfer 116 presses the capture button 117 on the viewfinder 104, the target information, which will be based on the current orientation of the viewfinder 104 will be wirelessly transmitted to the golf club mounted indicator device 106 by a transmitter (not shown) in the viewfinder 104.

The golf club mounted indicator device 106 is mounted on a golf club 120, or may be integrally formed as part of a golf club 120 during manufacture. The golf club mounted indicator device 106 comprises means for receiving target information from the target selection device 102, 104. This will normally be in the form of a direction which the golf club face 124 should be aligned along, or information which could be used to derive a direction which the golf club face 124 should aligned along.

The golf club mounted indicator device 106 will also comprise means (not shown) for determining a positioning of the golf club face 124. This means for determining a positioning of the golf club face 124 may comprise one or more of an accelerometer, a gyroscope, a magnetometer, and/or a compass. This provides information on the current positioning of the golf club face 124.

There may also be provided a processor within the golf club mounted indicator device 106 to use the target information received by the golf club mounted indicator device 106 and the information from the accelerometer, the gyroscope, the magnetometer and/or the compass, so as to determine when the golf club face 124 is aligned towards the selected target.

In alternative embodiments, the processor may be provided in the viewfinder 104 or the handheld unit 102 and in this embodiment, the golf club mounted indicator device 106 would comprise a transceiver to send information from the accelerometer, the gyroscope, the magnetometer and/or the compass, and, to receive indicator on or indicator off information from the processor which will be located remotely from the golf club mounted indicator device 106. In this manner, power intensive computation and processing can be done remotely form the golf club mounted indicator device 106.

Figure 3:
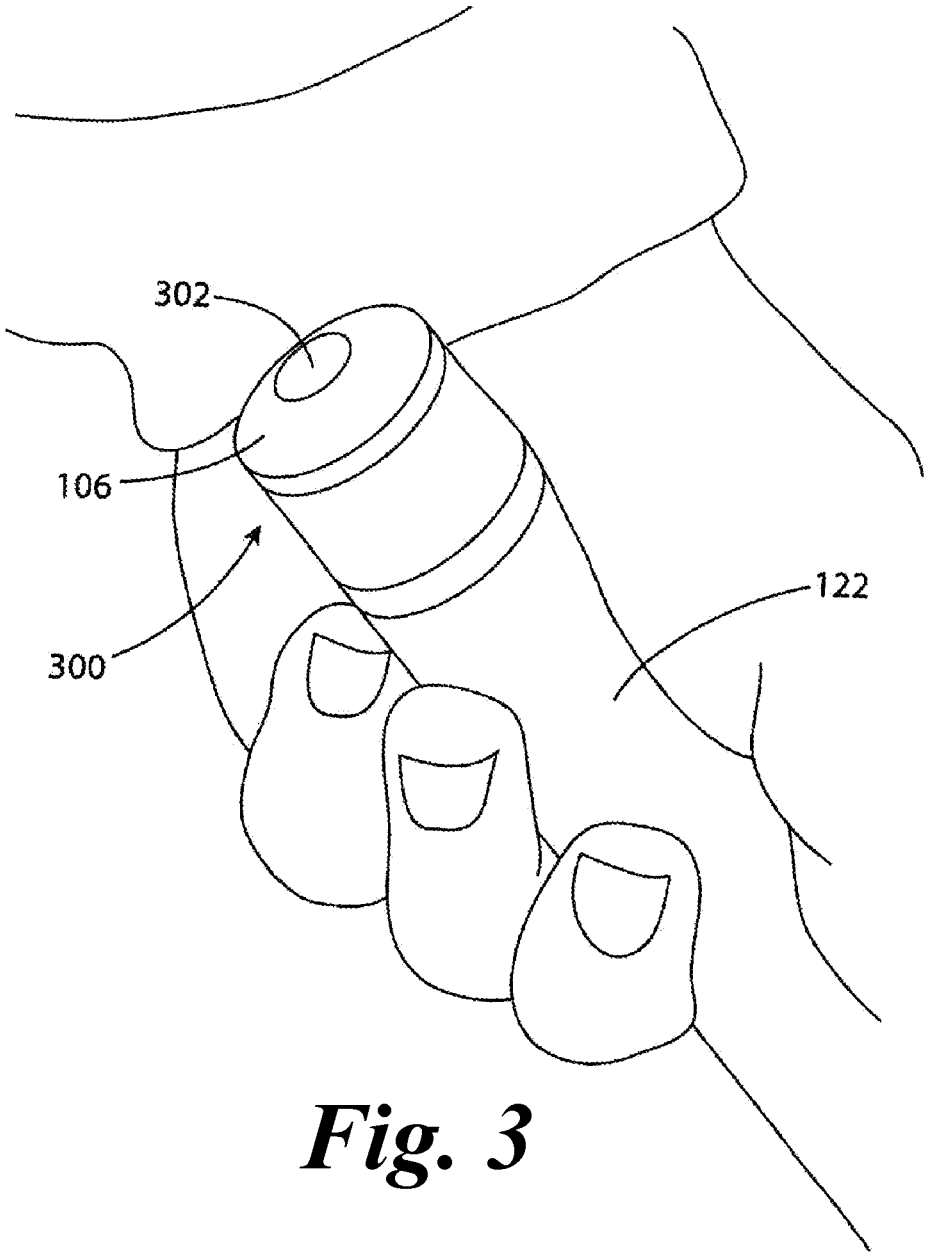
FIG. 3 is a detail perspective view of a golf club mounted indicator device which forms part of one of the embodiments of the present invention.

Referring now to FIG. 3, the golf club mounted indicator device 106 is mounted on a top end portion indicated generally by reference numeral 300 of a golf club handgrip 122 at a top end of a golf club 120 shaft. The top end portion 300 is at an opposite end of the golf club 120 to the golf club face 124. A light emitting diode (LED) 302 is provided as the indicator light on the golf club mounted indicator device 106. The light emitting diode (LED) 302 will turn from green to red when the golf club face 124 is aligned to the selected target.

In further embodiments, other types of indicators may be used to indicate when the positioning of the golf club face 124 is suitable to align the golf club face 124 towards the selected target 110. For example, the golf club mounted indicator device 106 may comprise a light, as above, although not necessarily a LED light, to provide feedback on the alignment of the golf club face 124, or, the golf club mounted indicator device 106 may comprises a haptic engine to provide vibrational feedback on the alignment of the golf club face 124 or a speaker to provide a sound when the golf club face 124 is aligned correctly.

In a preferred embodiment of the invention, and in order to save the power being consumed by the golf club mounted indicator device 106, the golf club mounted indicator device 106 comprises a tip switch which is used to control the power being fed to the golf club mounted indicator device 106. When the golf club 120 is placed in a golf bag, the golf club 120 will have its golf club face 124 above the golf club handgrip 122. In essence, the golf club 120 will be upside down and so too will the golf club mounted indicator device 106 be upside down. When the tip switch senses that the golf club mounted indicator device 106 is upside down, the power will be prevented from being supplied to the golf club mounted indicator device 106 and the golf club mounted indicator device 106 will be effectively powered off. When the tip switch senses that the golfer 116 has taken the golf club 120 out of the golf bag and the golf club 120 has been rotated by a preset angle, say 135° from its upside-down situation, the tip switch will power back on the golf club mounted indicator device 106.

In a further embodiment, the viewfinder 104 may further comprise a rangefinder to allow a golfer 116 to determine a distance to a pin or their intended target 110. The range finder may preferably be of a standard laser range finder design.

Figure 4A:
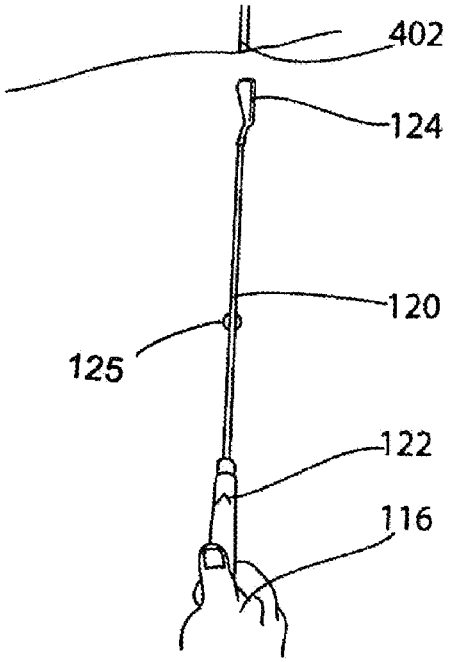
FIG. 4*a* is a perspective view of a golf club mounted golf shot alignment device of another embodiment of the present invention, where a golf club mounting the golf club mounted golf shot aiming device is being used as a target selector.
Figure 4B:
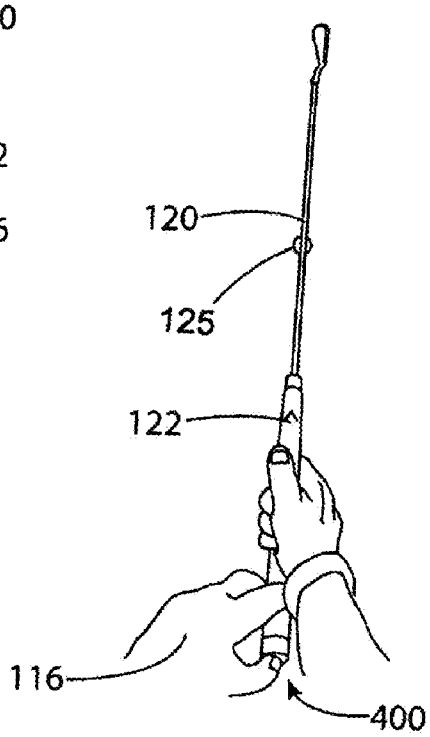
FIG. 4*b* is a perspective view of the golf club mounted golf shot alignment device of FIG. 4*a*, with a user locking the golf club mounted golf shot alignment device onto a selected target.
Figure 4C:
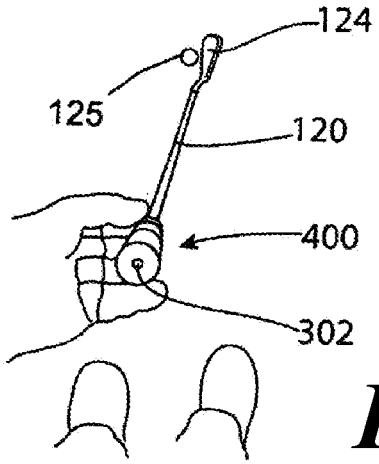
FIG. 4*c* is a perspective view of the golf club mounted golf shot alignment device of FIG. 4*a*, with an indicator on the golf club mounted golf shot alignment device informing the user when the golf club face is aligned with the selected target.

Turning now to FIGS. 4*a* to 4*c* inclusive, there is shown another embodiment of the present invention. A golf club mounted golf shot alignment device is indicated generally by reference numeral 400. The golf club mounted golf shot alignment device 400 is used to assist a golfer 116 to align a golf club face 124 towards a selected target 402. The golf club mounted golf shot alignment device 400 comprises a target selection device and an indicator device. The golf shot alignment device 400 is mounted on a golf club 120 which comprises the golf club face 124. In a preferred embodiment the golf shot alignment device 400 is mounted on a top end of a handgrip 122 of the golf club 120.

In use, a golfer will hold their golf club 120 is a substantially horizontal position and point the golf club 120 towards an intended target 402. That is, the golf club 120 is aligned between their golf ball 125 at the current location 112 and the intended target 402 which might be the centre of a fairway or a flagstick on a green for example. This is shown in FIG. 4*a*. When the golfer 116 is satisfied that the longitudinal axis of the shaft of the golf club 120 is correctly aimed at the intended target 402, the golfer 116 will push a button 302 on the golf club mounted golf shot alignment device 400 as shown in FIG. 4*b*. This triggers the target selection device to capture the direction in which the golf club 120 is being pointed. This target information captured by the target selection device is then passed to the indicator device in the golf club mounted golf shot alignment device 400. The target selection device is therefore capable of communicating with the indicator device so as to provide target information from the target selection device to the indicator device. The golfer 116 will then, having pressed a button 302 or completed some analogous action which has triggered the target selection device to capture the target information and caused the target information to be passed on to the indicator device, return the golf club 120 to the normal substantially vertical playing position (as shown in FIG. 4*c*) and begin to line up their shot towards the intended target 402. The indicator device comprises means to use the target information to determine when the golf club face 124 is aligned towards the selected target 402. An indicator 302 incorporated in the button 302 is then activated on the golf club mounted golf shot alignment device 400 to indicate to the golfer 116 that the golf club face 124 is now aimed towards the target 402. This is shown in FIG. 4*c*.

It will be appreciated that, as before, a light emitting diode (LED) 302 is provided as the indicator light on the golf club mounted golf shot alignment device 400 shown in FIGS. 4*a* to 4*c*. Although, in further embodiments, other types of indicators may be used to indicate when the positioning of the golf club face 124 is suitable to align the golf club face 124 towards the selected target 402, such as, any type of light, a haptic engine, or, a speaker to indicate to the golfer 116 when the golf club face 124 is aligned correctly to the target 402.

As with the preceding embodiments, where the target selection device and the indicator device were remote from one another, the advantage with forcing the golfer 116 to line up their next shot using their golf club 120 in a substantially horizontal manner is that the golfer 116 becomes accustomed to selecting the target 402 when standing predominately facing on to the target 402, and then further accustomed to associating the correct club alignment to the selected target 402, when the golfer 116 is standing side on to the target 402, as is normal when addressing the golf ball 125 to be struck.

This embodiment, where the target device and indicator device are incorporated into a single golf club mounted device 400 will work analogously to the earlier described embodiment. In this current embodiment, the target device will comprise an orientation means (not shown) for assessing which orientation the golf club 120 currently has. This orientation means may simply be a compass, or magnetometer, which can provide information on the directional orientation of the golf club 120.

When the golfer 116 presses the capture button 302 there will be means, such as a memory, for capturing the target information from the orientation means. The target information will typically be in the form of a direction which the golf club face 124 should be aligned towards. Alternatively, the target information may comprise information which could be used to derive a direction which the golf club face 124 should be aligned towards.

The golf club mounted golf shot alignment device 400 will also comprise means (not shown) for determining a positioning of the golf club face 124. This means for determining a positioning of the golf club face 124 may comprise one or more of an accelerometer, a gyroscope, a magnetometer, and/or a compass. This provides information on the current positioning of the golf club face 124. There may also be provided a processor within golf club mounted golf shot alignment device 400 to use the target information and the information from the accelerometer, the gyroscope, the magnetometer and/or the compass, so as to determine when golf club face 124 is aligned towards the selected target 402.

Figure 5A:
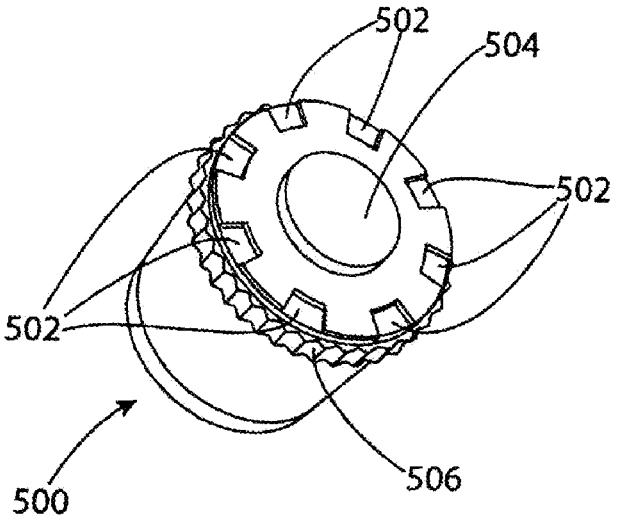
FIG. 5*a* is a diagrammatic perspective view of a further embodiment of the golf club mounted golf shot alignment device according to the invention.
Figure 5B:
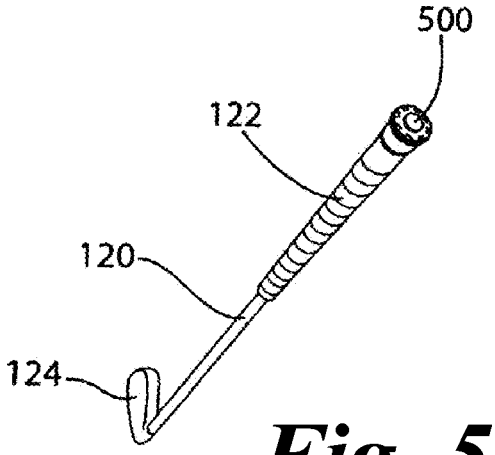
FIG. 5*b* is a diagrammatic perspective view of the golf club mounted golf shot alignment device of FIG. 5*a*, shown mounted on a golf club.

With reference to FIGS. 5*a* and 5*b*, there is shown another embodiment of the present invention. A golf club mounted golf shot alignment device is indicated generally by reference numeral 500. The golf club mounted golf shot alignment device 500 is again used to assist a golfer to align a golf club face 124 towards a selected target 110, 402. As with the embodiment shown in FIGS. 4*a* to 4*c*, the golf club mounted golf shot alignment device 500 comprises a target selection device and an indicator device. As seen in FIG. 5*b*, the golf shot alignment device 500 is mounted on a golf club 120 which comprises the golf club face 124. In a preferred embodiment the golf shot alignment device 500 is mounted on a top end of a handgrip 122 of the golf club 120.

The golf shot alignment device 500 comprises a button 504 to trigger the target selection device to capture the direction in which the golf club 120 is being pointed. This target information captured by the target selection device is then passed to the indicator device in the golf club mounted golf shot alignment device 500. When the golfer returns the golf club 120 to the normal substantially vertical playing position and begins to line up their shot towards the intended target 110, 402, the indicator device comprises means to use the target information to determine when the golf club face 124 is aligned towards the selected target 110, 402. An indicator 502 is then activated on the golf club mounted golf shot alignment device 500 to indicate to the golfer 116 that the golf club face 124 is now aimed towards the target 110, 402 or is off target.

The indicator 502 may comprise a plurality of circumferentially spaced-apart LEDs as shown in FIG. 5*a*. The indicator 502 may be illuminated in one colour, say blue, if the club face 124 is closed, or another colour, say orange, if the club face 124 is open, or a third colour, say green, if the club face 124 is square on to the selected target 110, 402. The indication that the club face 124 is open or closed will help the golfer 116 line up their shot in a shorter amount of time.

As before, in further embodiments, other types of indicators may be used to indicate when the positioning of the golf club face 124 is suitable to align the golf club face 124 towards the selected target 110, 402, such as, any type of light, a haptic engine, or, a speaker to indicate to the golfer when the golf club face 124 is aligned correctly to the target 110, 402.

The golf shot alignment device 500 further comprises a rotating click-wheel 506, or an analogous input means, which enables a golfer 116 to request the golf shot alignment device 500 to align the club face 124 intentionally off target from the selected target 110, 402. This is useful if the golfer wishes to shape an approach shot or a drive, around an obstacle on the course. For example, each click rotation of the wheel 506 may represent a 1°, 2°, 5° or other preset amount off the target 110, 402. It will be understood that rotating in a clockwise manner (when viewing the golf shot alignment device 500 from the top, free end of the golf shot alignment device 500), may open up the club face 124 to assist with a fade shot, or, rotating in an anti-clockwise manner (when viewing the golf shot alignment device 500 from the top, free end of the golf shot alignment device 500), may close the club face 124 to assist with a draw shot.

It will be appreciated that the viewfinder 104 or the handheld unit 102 of the earlier described embodiments could also be used to input an intentional offset to a selected target 110, 402. The offset input may be also used for countering a golfer's natural swing errors, although it will be appreciated that this type of use is not helpful for improving and correcting such errors.

In a further embodiment, the golf club mounted indicator device 106 of the golf shot alignment system 100, or the golf club mounted golf shot alignment device 400, 500 may comprise means to recognise when the golf club 120 has struck a golf ball 125. An accelerometer or such device may be used to detect such an impact. At the time of the detected impact, the golf club mounted indicator device or the golf club mounted golf shot alignment device 400, 500 would detect, using the same components as used for lining up a shot, whether the golf club face 124 was open, closed or square on to the selected target at impact. Where an intentional offset has been input to the golf club mounted golf shot alignment device 500, this would be taken into account when detecting if the golf club face 124 had the correct alignment at the time of impact.

Over time, as a historical record of a golfer's tendencies is established, in yet a further embodiment, the golf club mounted indicator device 106, or the golf club mounted golf shot alignment device 400, 500 may automatically correct for the tendencies of a specific golfer by automatically offsetting the club face angle from the selected target 110, 402 in order to correct for the golfer's natural habit to open or close the club face 124. The degree to which this offset is countered automatically can be established by averaging out the historical records. Where a golf shot is struck by the golfer 116, and the golf club face 124 is significantly open or closed, say by 30° or more, then the averaging process may ignore such records as it is clearly a badly mishit shot. Again, this feature of this embodiment is not good for helping a golfer 116 to improve their game as it attempts to counter a golfer's natural bad habits; however, it may be useful in certain situations where a golfer 116 wishes to have more immediate assistance in hitting more accurate golf shots.

For charging of the golf club mounted devices, in a further embodiment of the present invention, it is also envisaged to use wireless charging means as are known in the art, such as using an electromagnetic field by way of inductive charging. Typically, a primary coil in a charging pad or mat is used to create an electromagnetic field which through inductive coupling is linked to a secondary coil and charges a device 106, 400, 500 incorporating the secondary coil. Other techniques are also known and included within the scope of this application. It is envisaged to place the charging pad/mat on top of an interior floor of a golf bag, or possibly integrate the primary coil into the floor of the golf bag during manufacture. In this way, when a golf club 120 is returned to the golf bag in the normal manner, the golf club mounted device 106, 400, 500 will sit directly on top of, or in very close proximity to, such a charging pad/mat. A small rechargeable battery in the golf club mounted device 106, 400, 500 could then be recharged via such wireless charging means.

In an alternative arrangement, the golf club mounted indicator device 106, 400, 500 could be powered by an external power source, a rechargeable battery on the golfer's glove, and a very thin pad in the palm of the glove that would use induction charging to power the club mounted indicator device 106, 400, 500 through the golf club handgrip 122.

The terms "comprise" and "include", and any variations thereof required for grammatical reasons, are to be considered as interchangeable and accorded the widest possible interpretation.

It will be understood that the components shown in any of the drawings are not necessarily drawn to scale, and, like parts shown in several drawings are designated the same reference numerals.

It will be further understood that features from any of the embodiments may be combined with alternative described embodiments, even if such a combination is not explicitly recited hereinbefore but would be understood to be technically feasible by the person skilled in the art.

The invention is not limited to the embodiments hereinbefore described which may be varied in both construction and detail with the scope of the appended claims.

What is claimed is:

1. A golf club mounted golf shot alignment device for assisting a golfer to align a golf club face towards a selected target, the golf shot alignment device comprising:

a target selection device; and an indicator device;

the golf shot alignment device for mounting on a golf club which comprises the golf club face at a bottom end of a shaft and a handgrip at a top end of the shaft;

the target selection device being capable of communicating with the indicator device so as to provide target information from the target selection device to the indicator device; and, the indicator device comprising means to use the target information to determine when the golf club face is aligned towards the selected target;

wherein:

the golf shot alignment device comprises means to mount the golf shot alignment device on a top end portion of a golf club at the handgrip, the top end portion being at an opposite end of the golf club to the golf club face, the indicator device comprising a light to provide feedback on the alignment of the golf club face, the golf shot alignment device having a capture button mounted on the golf club at the handgrip, such that when the golfer holds the golf club by the handgrip in a horizontal position and aligns the golf club between their golf ball and the target and then presses the capture button this will cause the target selection device to capture the direction in which the golf club shaft is pointing at the target as the target information and send the target information to the indicator device to facilitate subsequent correct alignment of the golf club face with the golf ball when addressing the golf ball .

2. The device as claimed in claim 1, wherein the indicator device comprises means for receiving target information from the target selection device, means for determining a positioning of the golf club face; and an indicator to indicate when the positioning of the golf club face is suitable to align the golf club face towards the selected target.

3. The device as claimed in claim 1, wherein the light of the indicator device changes from a first colour to a second colour to indicate when the golf club face has been aligned to the selected target.

4. The device as claimed in claim 1, wherein the golf club mounted golf shot alignment device comprises one or more of: an accelerometer, a gyroscope, a magnetometer, and a compass and a processor to use the target information and the information from the accelerometer, the gyroscope, the magnetometer and/or the compass, so as to determine when the golf club face is aligned towards the selected target.

5. The device as claimed in claim 1, wherein the target information and/or the aiming information is a directional vector from a current location to the target location and/or GPS co-ordinates of the selected target.

6. The device as claimed in claim 1, wherein the target selection device and the indicator device are separate devices, operated remotely from one another, and communicating wirelessly with one another.

7. A golf club mounted golf shot alignment device for assisting a golfer to align a golf club face towards a selected target, the golf shot alignment device comprising:

a target selection device; and an indicator device;

the golf shot alignment device for mounting on a golf club which comprises the golf club face at a bottom end of a shaft and a handgrip at a top end of the shaft;

the target selection device being capable of communicating with the indicator device so as to provide target information from the target selection device to the indicator device; and, the indicator device comprising means to use the target information to determine when the golf club face is aligned towards the selected target, wherein:

the golf shot alignment device comprises means to mount the golf shot alignment device on a top end portion of a golf club at the handgrip, the top end portion being at an opposite end of the golf club to the golf club face, the indicator device comprising a light to provide feedback on the alignment of the golf club face, the golf shot alignment device having a capture button mounted on the golf club at the handgrip, such that when the golfer holds the golf club by the handgrip in a horizontal position and aligns the golf club between their golf ball and the target and then presses the capture button this will cause the target selection device to capture the direction in which the golf club shaft is pointing at the target as the target information and send the target information to the indicator device to facilitate subsequent correct alignment of the golf club face with the golf ball when addressing the golf ball, the golf shot alignment device having a click-wheel rotatably mounted on the golf shot alignment device which is operable to request the golf shot alignment device to align the club face intentionally off target from the selected target, each click rotation of the click-wheel representing a preset amount of degrees off the selected target to open the club face or close the club face when addressing the golf ball.

* * * * *